US010914544B2

(12) United States Patent
Cao et al.

(10) Patent No.: US 10,914,544 B2
(45) Date of Patent: Feb. 9, 2021

(54) CONTROL MECHANISM OF VEHICLE-MOUNTED SYSTEM FOR ELECTROMAGNETIC LAUNCH OF FIRE EXTINGUISHING BOMBS FOR HIGH-RISE BUILDINGS

(71) Applicants: Northwestern Polytechnical University, Shaanxi (CN); Shaanxi Dagong Xuhang Electromagnetic Technology Co., Ltd., Shaanxi (CN)

(72) Inventors: Zengqiang Cao, Shaanxi (CN); Guo Zheng, Shaanxi (CN); Chenglong Dang, Shaanxi (CN); Lingfeng Wei, Shaanxi (CN); Yanan Chang, Shaanxi (CN)

(73) Assignees: NORTHWESTERN POLYTECHNICAL UNIVERSITY, Shaanxi (CN); SHAANXI DAGONG XUHANG ELECTROMAGNETIC TECHNOLOGY CO., LTD., Shaanxi (CN)

( * ) Notice: Subject to any disclaimer, the term of this patent is extended or adjusted under 35 U.S.C. 154(b) by 0 days.

(21) Appl. No.: 16/886,151

(22) Filed: May 28, 2020

(65) Prior Publication Data

US 2020/0408483 A1 Dec. 31, 2020

(30) Foreign Application Priority Data

Jun. 25, 2019 (CN) ..... 2019 1 0552268

(51) Int. Cl.

| | |
|---|---|
| ***A62C 3/02*** | (2006.01) |
| ***F41B 6/00*** | (2006.01) |
| ***F42B 12/46*** | (2006.01) |
| ***A62C 19/00*** | (2006.01) |

(52) U.S. Cl.

CPC ..... *F41B 6/003* (2013.01); *A62C 3/025* (2013.01); *A62C 19/00* (2013.01); *F42B 12/46* (2013.01)

(58) Field of Classification Search

CPC ..... F41B 6/003; A62C 19/00; A62C 3/025

See application file for complete search history.

(56) References Cited

FOREIGN PATENT DOCUMENTS

CN 105944262 A 9/2016

*Primary Examiner* — Reginald S Tillman, Jr.

(74) *Attorney, Agent, or Firm* — Hoffmann & Baron, LLP

(57) ABSTRACT

A control mechanism of a vehicle-mounted system for electromagnetic launch of fire extinguishing bombs for high-rise buildings is provided. A stress wave amplifier is fixedly connected to a secondary coil, a primary coil is fixedly connected to a coil base, a guide shaft passes through a central hole in the primary coil and the coil base, and a head of the guide shaft is fixedly connected to the secondary coil. A step-up transformer TM1 boosts a 380-V alternating current and changes it to direct current to charge a pulse capacitor C1 and store energy in the pulse capacitor C1. A discharge thyristor M3 is triggered, and the pulse capacitor C1 releases the energy instantaneously. A stress wave is generated between the primary coil and the secondary coil. The stress wave is transmitted to a fire extinguishing bomb through the stress wave amplifier, to launch the fire extinguishing bomb.

3 Claims, 2 Drawing Sheets

CONTROL MECHANISM OF VEHICLE-MOUNTED SYSTEM FOR ELECTROMAGNETIC LAUNCH OF FIRE EXTINGUISHING BOMBS FOR HIGH-RISE BUILDINGS

CROSS-REFERENCE TO RELATED APPLICATIONS

This application claims priority to Chinese Patent Application No. 201910552268.9, filed on Jun. 25, 2019, the disclosure of which is incorporated by reference herein in its entirety for all purposes.

TECHNICAL FIELD

The present invention relates to a control system, and in particular, to a control mechanism of a vehicle-mounted system for electromagnetic launch of fire extinguishing bombs for high-rise buildings.

BACKGROUND

Fire extinguishing bombs are the main way to extinguish fire in high-rise buildings. Conventionally, fire extinguishing bombs are usually thrown by hand, gunpowder, or air cannon. Throwing fire extinguishing bombs by hand is impractical due to the short launch distance. Throwing fire extinguishing bombs by gunpowder or air cannon does not have this problem, but the launch distance is unadjustable, fire extinguishing bombs cannot be thrown in rapid succession, and there are potential safety risks that may easily cause panic to firefighters.

Chinese patent CN105944262A discloses a system for electromagnetic launch of fire extinguishing bombs for high-rise buildings. The system uses a multi-stage coil to accelerate the launch of fire extinguishing bombs, achieving an initial launch velocity adjustable within 300 m/s, with low noise and good safety. However, the system uses a photoelectric monitoring system to detect a position of a fire extinguishing bomb, to further control the closing of a driving coil of each stage. This control method has extremely high requirements for the monitoring system and the switching accuracy. The photoelectric monitoring system and the us-level switch are costly. In addition, this system does not provide circuits for a power supply system and a control system, and therefore the system is incomplete and difficult to use in practice.

SUMMARY

To address the poor practicality of the existing system for electromagnetic launch of fire extinguishing bombs for high-rise buildings, the present invention provides a control mechanism of a vehicle-mounted system for electromagnetic launch of fire extinguishing bombs for high-rise buildings. The control mechanism includes an electronic circuit, a guide shaft, a coil base, a primary coil, a secondary coil, and a stress wave amplifier. The stress wave amplifier is fixedly connected to the secondary coil, the primary coil is fixedly connected to the coil base, the guide shaft passes through a central hole in the primary coil and the coil base, and a head of the guide shaft is fixedly connected to the secondary coil. A step-up transformer TM1 boosts the 380 V alternating current and changes it to direct current through a rectifier bridge to charge a pulse capacitor C1 and store energy in the pulse capacitor C1. A discharge thyristor M3 is triggered, and the pulse capacitor C1 releases the energy instantaneously. A stress wave is generated due to a huge eddy current repulsion generated between the primary coil and the secondary coil. The stress wave is transmitted to a fire extinguishing bomb through the stress wave amplifier, causing the fire extinguishing bomb to be launched at a high speed. The present invention adopts single-stage launch, which solves the technical problems of multi-stage coil launch that requires high-precision components and is costly and difficult to realize. By making use of the charging and discharging of the capacitor, the present invention achieves a high control accuracy and a good repeatability, and controls the error to be within 1%. In addition, the maximum charging voltage can reach 5000 V, allowing a 4 KG fire extinguishing bomb to be launched at a speed of up to 500 m/s. The charging time is controlled within 3 s.

The present invention adopts the following technical solutions: a control mechanism of a vehicle-mounted system for electromagnetic launch of fire extinguishing bombs for high-rise buildings, including: a step-up transformer TM1, rectifier diodes D1 and D2, rectifier thyristors M1 and M2, a current limiting resistor R1, a smoothing inductor L1, a voltmeter V1, a pulse capacitor C1, a bleeder resistor R2, a discharge thyristor M3, a freewheeling diode D3, a current sensor TA1, a voltage sensor TV1, a temperature sensor ST1, a contactor J1, a guide shaft 1, a coil base 2, a primary coil 3, a secondary coil 4, and a stress wave amplifier 5, where the rectifier thyristor M1 is connected in series to the rectifier diode D1, the rectifier thyristor M2 is connected in series to the rectifier diode D2, and then the two series-connected circuits are connected in parallel to form a rectifier bridge; positive electrodes of the rectifier diodes D1 and D2 serve as positive electrodes of the rectifier bridge, and negative electrodes of the rectifier thyristors M1 and M2 serve as negative electrodes of the rectifier bridge; output terminals of the step-up transformer TM1 are connected to positive electrodes of the rectifier thyristors M1 and M2; the current sensor TA1 is connected to either of the output terminals of the step-up transformer TM1; the negative electrodes of the rectifier bridge are connected to one terminal of the current limiting resistor R1, the other terminal of the current limiting resistor R1 is connected to one terminal of the smoothing inductor L1, the other terminal of the smoothing inductor L1 is connected to a positive electrode of the discharge thyristor M3, a negative electrode of the discharge thyristor M3 is connected to a positive electrode of the primary coil 3, and a negative electrode of the primary coil 3 is connected to the negative electrodes of the rectifier bridge to form a complete loop; the voltmeter V1, the pulse capacitor C1, the freewheeling diode D3, and the voltage sensor TV1 are connected in parallel between the positive electrode of the discharge thyristor M3 and the positive electrodes of the rectifier bridge, and the breeder resistor R2 and a switch of the contactor J1 are connected in series and then connected in parallel between the positive electrode of the discharge thyristor M3 and the positive electrodes of the rectifier bridge; the stress wave amplifier 5 and the secondary coil 4 are connected by bolts, the primary coil 3 and the coil base 2 are connected by bolts, and a central hole is opened on the primary coil 3 and the coil base 2, to allow the guide shaft 1 through; and a head of the guide shaft 1 is provided with an external thread, which is connected with an internal thread provided in a center of the secondary coil 4.

The present invention further provides a power circuit of the above control mechanism of the vehicle-mounted system for electromagnetic launch of fire extinguishing bombs for high-rise buildings, where a switch S1 is a main switch that controls on and off of a single-phase 380 V power supply, phase A and phase B are connected to a live wire and phase C is connected to a neutral wire; phase A of the switch S1 is connected in series to switches S2, S3, S4 and S5, a control switch of a contactor J2 is connected in parallel to the switch S5, a main switch of the contactor J2 is connected in series to the switch S1, a thermal protector FR1 is connected in series to the main switch of the contactor J2, an indicator L1 and a leakage protector RCD1 are connected in series to phase A and phase C of an output terminal of the thermal protector FR1, a filter F1 and the leakage protector RCD1 are connected in series and grounded, switches of contactors J3 and J4 are connected in series to phase A and phase B of the output terminal of the FR1, output terminals of the switch of the contactor J3 are connected in series to protective resistors R3 and R4, output terminals of the protection resistors R3 and R4 are respectively connected in series to an input terminal of the step-up transformer TM1, and output terminals of the switch of the contactor J4 are respectively connected in series to the input terminal of the step-up transformer.

The present invention further provides a control circuit of the above control mechanism of the vehicle-mounted system for electromagnetic launch of fire extinguishing bombs for high-rise buildings, where a programmable logic controller PLC is connected to an analog module EM, a touchscreen HMI, switches S6, S7, and S8, relays K1, K2, K3, and K4, and indicators L2 and L3, the analog module EM is connected to a voltage sensor TV1, a current sensor TA1, a temperature sensor ST1, and a voltage transducer TV2, the voltage transducer TV2 is connected to the circuit board PCB1, output terminals of the circuit board PCB1 are connected to the rectifier thyristors M1 and M2 and a pulse transformer IPI1, the pulse transformer IPI1 is connected to the discharge thyristor M3, and switches of the relays K1, K2, K3, and K4 are connected to coils of the contactors J1, J2, J3, and J4, respectively.

The present invention achieves the following beneficial effects: the control system includes an electronic circuit, a guide shaft, a coil base, a primary coil, a secondary coil, and a stress wave amplifier. The stress wave amplifier is fixedly connected to the secondary coil, the primary coil is fixedly connected to the coil base, the guide shaft passes through a central hole in the primary coil and the coil base, and a head of the guide shaft is fixedly connected to the secondary coil. A step-up transformer TM1 boosts the 380 V alternating current and changes it to direct current through a rectifier bridge to charge a pulse capacitor C1 and store energy in the pulse capacitor C1. A discharge thyristor M3 is triggered, and the pulse capacitor C1 releases the energy instantaneously. A stress wave is generated due to a huge eddy current repulsion generated between the primary coil and the secondary coil. The stress wave is transmitted to a fire extinguishing bomb through the stress wave amplifier, causing the fire extinguishing bomb to be launched at a high speed. The present invention adopts single-stage launch, which solves the technical problems of multi-stage coil launch that requires high-precision components and is costly and difficult to realize. By making use of the charging and discharging of the capacitor, the present invention achieves a high control accuracy and a good repeatability, and controls the error to be within 1%. In addition, the maximum charging voltage can reach 5000 V, allowing a 4 KG fire extinguishing bomb to be launched at a speed of up to 500 m/s. The charging time is controlled within 3 s. The following describes the present invention in detail with reference to the accompanying drawings and specific examples.

In the figures, 1. guide shaft, 2, coil base, 3. primary coil, 4. secondary coil, 5. stress wave amplifier, and 6. fire extinguishing bomb.

DETAILED DESCRIPTION

Figure 1:
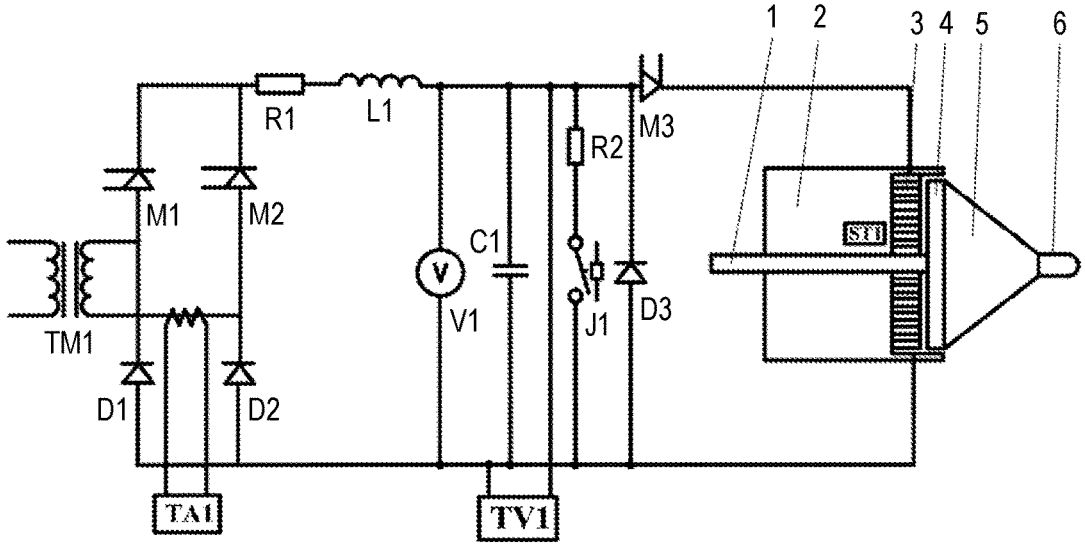
FIG. 1 is a schematic diagram of a control mechanism of a vehicle-mounted system for electromagnetic launch of fire extinguishing bombs for high-rise buildings, according to the present invention.
Figure 2:
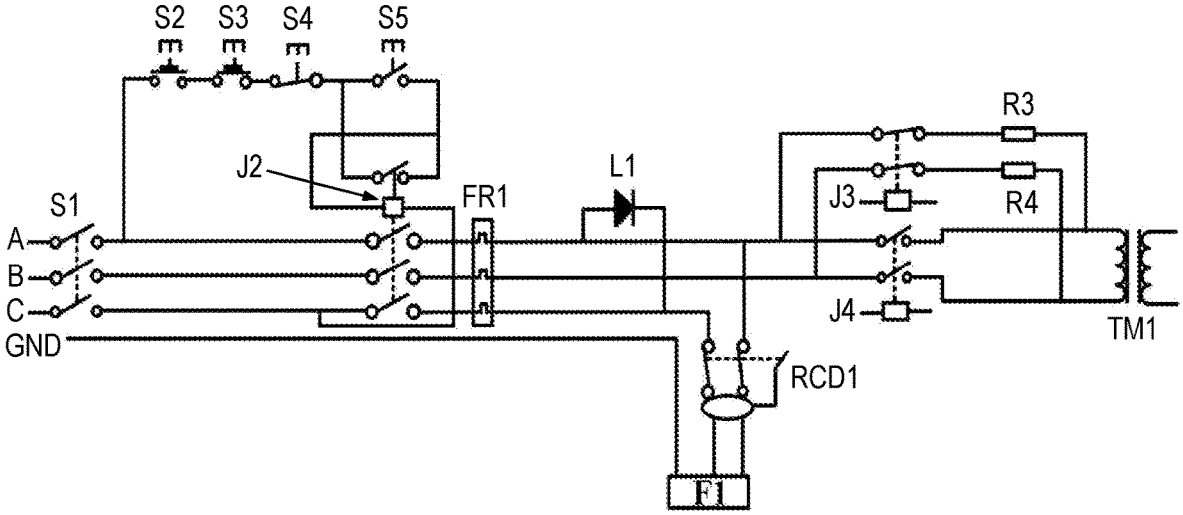
FIG. 2 is a circuit diagram of a power supply system for the control mechanism in FIG. 1.
Figure 3:
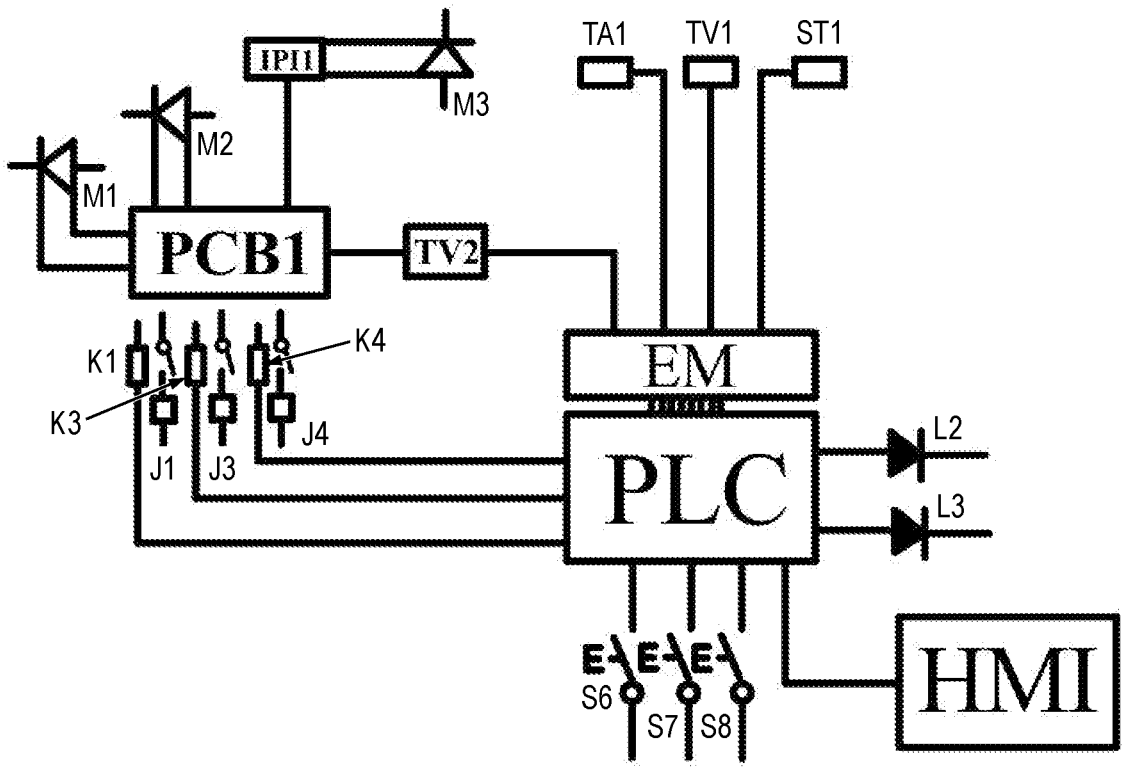
FIG. 3 is a circuit diagram of a control system for the control mechanism in FIG. 1.

For the following examples, see FIG. 1 to FIG. 3.

A control mechanism of a vehicle-mounted system for electromagnetic launch of fire extinguishing bombs for high-rise buildings according to the present invention includes a step-up transformer TM1, rectifier diodes D1 and D2, rectifier thyristors M1 and M2, a current limiting resistor R1, a smoothing inductor L1, a voltmeter V1, a pulse capacitor C1, a bleeder resistor R2, a discharge thyristor M3, a freewheeling diode D3, a current sensor TA1, a voltage sensor TV1, a temperature sensor ST1, contactors J1, J2, J3, and J4, a thermal protector FR1, a leakage protector RCD1, a filter F1, protection resistors R3 and R4, switches S1, S2, S3, S4, S5, S6, S7, and S8, indicators L1, L2, and L3, a touchscreen HMI, a programmable logic controller PLC, an analog module EM, a voltage transducer TV2, a circuit board PCB1, relays K1, K2, K3, and K4, a pulse transformer IPI1, a guide shaft 1, a coil base 2, a primary coil 3, a secondary coil 4, a stress wave amplifier 5, and a fire extinguishing bomb 6. The rectifier thyristor M1 is connected in series to the rectifier diode D1, the rectifier thyristor M2 is connected in series to the rectifier diode D2, and then the two series-connected circuits are connected in parallel to form a rectifier bridge. Positive electrodes of the rectifier diodes D1 and D2 serve as positive electrodes of the rectifier bridge, and negative electrodes of the rectifier thyristors M1 and M2 serve as negative electrodes of the rectifier bridge. Output terminals of the step-up transformer TM1 are connected to positive electrodes of the rectifier thyristors M1 and M2; the current sensor TA1 is connected to either of the output terminals of the step-up transformer TM1; the negative electrodes of the rectifier bridge are connected to a positive electrode of the current limiting resistor R1; a negative electrode of the current limiting resistor R1 is connected to a positive electrode of the smoothing inductor L1; a negative electrode of the smoothing inductor L1 is connected to a positive electrode of the discharge thyristor M3; a negative electrode of the discharge thyristor M3 is connected to a positive electrode of the primary coil 3; and a negative electrode of the primary coil 3 is connected to the negative electrodes of the rectifier bridge to form a complete loop. The voltmeter V1, the pulse capacitor C1, the freewheeling diode D3, and the voltage sensor TV1 are connected in parallel between the positive electrode of the discharge thyristor M3 and the positive electrodes of the rectifier bridge, and the breeder resistor R2 and a switch of the contactor J1 are connected in series and then connected in parallel between the positive electrode of the discharge thyristor M3 and the positive electrodes of the rectifier bridge. The stress wave amplifier 5 and the secondary coil 4 are connected by bolts, the primary coil 3 and the coil base 2 are connected by bolts, and a central hole is opened on the primary coil 3 and the coil base 2, to allow the guide shaft 1 through; and ahead of the guide shaft 1 is provided with an external thread, which is connected with an internal thread provided in a center of the secondary coil 4. The switch S1 is a main switch that controls on and off of a single-phase 380 V power supply. Phase A and phase B are connected to a live wire and phase C is connected to a neutral wire. Phase A of the switch S1 is connected in series to the switches S2, S3, S4 and S5. A control switch of the contactor J2 is connected in parallel to the switch S5, and a main switch of the contactor J2 is connected in series to the switch S1. The thermal protector FR1 is connected in series to the main switch of the contactor J2. The indicator L1 and the leakage protector RCD1 are connected in series to phase A and phase C of an output terminal of the thermal protector FR1. The filter F1 and the leakage protector RCD1 are connected in series and grounded. Switches of the contactors J3 and J4 are connected in series to phase A and phase B of the output terminal of the FR1. Output terminals of the switch of the contactor J3 are connected in series to the protective resistors R3 and R4. Output terminals of the protection resistors R3 and R4 are respectively connected in series to an input terminal of the step-up transformer TM1, and output terminals of the switch of the contactor J4 are respectively connected in series to the input terminal of the step-up transformer. The programmable logic controller PLC is connected to the analog module EM, the touchscreen HMI, the switches S6, S7, and S8, the relays K1, K2, K3, and K4, and the indicators L2 and L3. The analog module EM is connected to the voltage sensor TV1, the current sensor TA1, the temperature sensor ST1, and the voltage transducer TV2. The voltage transducer TV2 is connected to the circuit board PCB1. Output terminals of the circuit board PCB1 are connected to the rectifier thyristors M1 and M2 and the pulse transformer IPI1. The pulse transformer IPI1 is connected to the discharge thyristor M3. Switches of the relays K1, K2, K3, and K4 are connected to coils of the contactors J1, J2, J3, and J4, respectively.

The switch S1 is the main switch, the switches S2 and S3 are gates, and the switch S4 is a normally closed switch. After the switch S1 is turned on, turn on the switches S2 and S3 in turn, and press the switch S5. The main switch of the contactor J2 is turned on after the contactor J2 is powered. The step-up transformer TM1 is turned on through the (normally closed) switch of the contactor J3. In this case, the indicator L1 is turned on. An operator can judge whether the circuit is connected through the indicator L1. The protection resistors R3 and R4 can reduce an instantaneous excitation current upon turn-on of the step-up transformer TM1, thereby protecting the circuit. After the step-up transformer TM1 is turned on for two seconds, the relay K4 is powered through program control of the programmable logic controller PLC, so that the contactor J4 is powered and closes the switch. One second later, the relay K3 is powered, so that the contactor J3 is powered and opens the switch. The operator can set the voltage on the touchscreen HMI, and then press the switch S6. The programmable logic controller PLC sends a received command to the circuit board PCB1 through the voltage transmitter TV2. After receiving a signal, the circuit board PCB1 amplifies the signal and triggers the rectifier thyristors M1 and M2. The step-up transformer TM1 boosts the 380 V AC power. The AC power is converted into direct current through the rectifier bridge composed of the rectifier thyristors M1 and M2 and the rectifier diodes D1 and D2, to charge the pulse capacitor C1, thereby storing energy in the pulse capacitor C1. The current limiting resistor R1 protects the components by controlling the current during charging, and the smoothing inductor L1 protects the components by controlling the current upon startup of the transformer. During the charging process, the operator can check the voltage of the pulse capacitor C1 at any time through the voltmeter V1. The voltage sensor TV1, the current sensor TA1, and the temperature sensor ST1 respectively collect voltage, current, and temperature signals and transmit them to the analog module EM. The analog module EM converts the signals for display on the touchscreen HMI. If the operator finds any anomalies, he can press the switch S8 (emergency stop switch), so that the system immediately stops working and triggers the indicator L3 (alarm indicator). After the charging is completed, if the operator finds that discharging fails, he can press the discharge button on the touchscreen HMI to power the relay K1, so that the contactor J1 is powered and closes the switch, and the energy in the pulse capacitor C1 is discharged through the bleeder resistor R2. If there is no anomaly and power can be discharged, the operator can press the switch S7. The programmable logic controller PLC receives a signal and transmits it to the circuit board PCB1. The circuit board PCB1 amplifies the signal, which is then converted into a pulse signal by the pulse transformer IPI1 to trigger the discharge thyristor M3. The pulse capacitor C1 releases the energy instantly, a huge eddy current repulsion is generated between the primary coil 3 and the secondary coil 4, and a stress wave is generated. The stress wave is transmitted to the fire extinguishing bomb 6 through the stress wave amplifier 5, and the fire extinguishing bomb 6 is launched at a high speed. The guide shaft 1 ensures that there is no deviation in the launch direction. The freewheeling diode D3 protects the pulse capacitor C1 by preventing secondary reverse charging of the pulse capacitor C1 by a first primary coil 3 and a second primary coil 10 due to electromagnetic induction during discharge.

The control mechanism of the vehicle-mounted system for electromagnetic launch of fire extinguishing bombs for high-rise buildings is implemented as follows:

Step 1. Turn on the switch S1, and press the switches S2, S3, and S5 to power on the system. Three seconds later, the switch of the contactor J4 is turned on, and the touchscreen HMI is ready.

Step 2. Set the charging voltage on the touchscreen HMI according to a required transmission speed. The transmission speed is calculated according to the formula $$V = \frac{KTU_0^2}{2m},$$

where V represents an extrusion speed, K represents a stress wave amplifier magnification, T represents a stress wave wavelength, $U_0$ represents the charging voltage, and m represents fire extinguishing bomb mass.

Step 3. Press the switch S6 (charge switch). The programmable logic controller PLC sends a signal to the circuit board PCB1 through the voltage transducer TV2 to trigger the rectifier thyristors M1 and M2. The pulse capacitor C1 starts charging. After the charging is completed, the indicator L2 is on. Then, check whether the actual voltage values displayed on the voltmeter V1 and the touchscreen HMI are the same as the specified voltage value. If discharging fails due to exceptions, press the discharge button on the touchscreen HMI, so that the pulse capacitor C1 discharges the energy through the bleeder resistor R2 and then is recharged.

Step 4. Place the fire extinguishing bomb 6 close to the stress wave amplifier 5, aim at a target, and press the switch S7 (discharge switch). The programmable logic controller PLC sends a signal to the circuit board PCB1, and triggers the discharge thyristor M3 through the pulse transformer IPI1. The pulse capacitor C1 releases the energy instantaneously to launch the fire extinguishing bomb 6 out.

Step 5. Repeat steps 3 and 4 to launch fire extinguishing bombs continuously.

What is claimed is:

1. A control mechanism of a vehicle-mounted system for electromagnetic launch of fire extinguishing bombs for high-rise buildings, comprising: a step-up transformer, first and second rectifier diodes, first and second rectifier thyristors, a current limiting resistor, a smoothing inductor, a voltmeter, a pulse capacitor, a bleeder resistor, a discharge thyristor, a freewheeling diode, a current sensor, a voltage sensor, a temperature sensor, a first contactor, a guide shaft, a coil base, a primary coil, a secondary coil, and a stress wave amplifier, wherein the first rectifier thyristor is connected in series to the first rectifier diode to form a first series-connected circuit, the second rectifier thyristor is connected in series to the second rectifier diode to form a second series-connected circuit, and the first and second series-connected circuits are connected in parallel to form a rectifier bridge; positive electrodes of the first and second rectifier diodes serve as positive electrodes of the rectifier bridge, and negative electrodes of the first and second rectifier thyristors serve as negative electrodes of the rectifier bridge; output terminals of the step-up transformer are connected to positive electrodes of the first and second rectifier thyristors; the current sensor is connected to one of the output terminals of the step-up transformer; the negative electrodes of the rectifier bridge are connected to one terminal of the current limiting resistor, the other terminal of the current limiting resistor is connected to one terminal of the smoothing inductor, the other terminal of the smoothing inductor is connected to a positive electrode of the discharge thyristor, a negative electrode of the discharge thyristor is connected to a positive electrode of the primary coil, and a negative electrode of the primary coil is connected to the negative electrodes of the rectifier bridge to form a complete loop; the voltmeter, the pulse capacitor, the freewheeling diode, and the voltage sensor are connected in parallel between the positive electrode of the discharge thyristor and the positive electrodes of the rectifier bridge, and the breeder resistor and a switch of the first contactor are connected in series and then connected in parallel between the positive electrode of the discharge thyristor and the positive electrodes of the rectifier bridge; the stress wave amplifier and the secondary coil are connected by bolts, the primary coil and the coil base are connected by bolts, and a central hole is opened on the primary coil and the coil base, to allow the guide shaft through; and a head of the guide shaft is provided with an external thread, which is connected with an internal thread provided in a center of the secondary coil.

2. A power circuit of the control mechanism of the vehicle-mounted system for electromagnetic launch of fire extinguishing bombs for high-rise buildings according to claim 1, wherein a first switch is a main switch that controls on and off of a single-phase 380-volt power supply, phase A and phase B are connected to a live wire and phase C is connected to a neutral wire; phase A of the first switch is connected in series to second, third, fourth and fifth switches, a control switch of a second contactor is connected in parallel to the fifth switch, a main switch of the second contactor is connected in series to the first switch, a thermal protector is connected in series to the main switch of the second contactor, a first indicator and a leakage protector are connected in series to phase A and phase C of an output terminal of the thermal protector, a filter and the leakage protector are connected in series and grounded, switches of third and fourth contactors are connected in series to phase A and phase B of the output terminal of the thermal protector, output terminals of the switch of the third contactor are connected in series to first and second protective resistors, output terminals of the first and second protection resistors are respectively connected in series to an input terminal of the step-up transformer, and output terminals of the switch of the fourth contactor are respectively connected in series to the input terminal of the step-up transformer.

3. A control circuit of the control mechanism of the vehicle-mounted system for electromagnetic launch of fire extinguishing bombs for high-rise buildings according to claim 1, wherein a programmable logic controller is connected to an analog module, a touchscreen, sixth, seventh and eighth switches, first, second, third and fourth relays, and second and third indicators, the analog module is connected to a voltage sensor, a current sensor, a temperature sensor, and a voltage transducer, the voltage transducer is connected to the circuit board, output terminals of the circuit board are connected to the first and second rectifier thyristors and a pulse transformer, the pulse transformer is connected to the discharge thyristor, and switches of the first, second, third and fourth relays are connected to coils of the first, second, third and fourth contactors, respectively.

* * * * *